United States Patent [19]

Jewell

[11] 3,968,921

[45] July 13, 1976

[54] FOAM PACKAGE FOR BREAKFAST FOODS

[75] Inventor: Donald K. Jewell, Naperville, Ill.

[73] Assignee: Restaurant Technology, Inc., Oak Brook, Ill.

[22] Filed: Aug. 6, 1975

[21] Appl. No.: 602,147

[52] U.S. Cl. ..... 229/2.5 R; 220/307; 220/337; 229/45 R

[51] Int. Cl.[2] ..... B65D 43/10; B65D 1/26

[58] Field of Search ..... 229/2.5, 44, 45; 220/340, 337, 338; 150/.5

[56] References Cited

UNITED STATES PATENTS

| | | | |
|---|---|---|---|
| 1,945,397 | 1/1934 | Gray | 229/2.5 |
| 3,426,935 | 2/1969 | Swett | 220/337 |
| 3,786,982 | 1/1974 | Rakes et al. | 229/2.5 |
| 3,800,998 | 4/1974 | Gask | 229/45 X |
| 3,851,789 | 12/1974 | Case | 150/.5 |
| 3,876,130 | 4/1975 | Haase | 229/44 X |
| 3,902,540 | 9/1975 | Commisso | 229/2.5 X |

FOREIGN PATENTS OR APPLICATIONS

| | | | |
|---|---|---|---|
| 26,204 | 12/1908 | United Kingdom | 220/337 |

*Primary Examiner*—Davis T. Moorhead
*Attorney, Agent, or Firm*—Dressler, Goldsmith, Clement & Gordon, Ltd.

[57] ABSTRACT

A foam package for food comprises a dish section and a cover section which are provided with hinging and latching mechanisms for closing and opening the package. The hinging and latching mechanisms comprise outwardly projecting tongues on the dish section which extend into complementary apertures in the cover section. The latching tongue is biased forwardly by the dish section. The dish section includes an outwardly extending peripheral flange which includes a handle means for carrying the dish section or the entire package.

5 Claims, 15 Drawing Figures

FOAM PACKAGE FOR BREAKFAST FOODS

This invention relates to foam packages for containing and keeping breakfast fresh foods in a hot, moist condition and protected against cooling.

The time and expense of packaging hot foods, especially at a fast food restaurant, is quite substantial. It is not only important to package such foods rapidly and at a minimum of expense, but it is also important to provide packaging which will keep the food therein hot and suitably moist for as long as possible. This benefits both the store operator and the customer who may wish to keep the food for some time before it is eaten.

At the present time, many fast food restaurants package and serve hot breakfasts, such as eggs, pancakes and sausages, in rigid plastic and paper containers. Some of these are open-topped. Some restaurants have used foam packages for serving some hot foods. Various types of foam packages have been designed and developed for packaging and serving hot foods. The use of expanded polystyrene packages for serving hot foods also provides efficiencies in material use not possible with denser paper or solid plastic. That represents a very substantial reduction in raw material usage with an attendant conservation of resources.

In accordance with the present invention, improved, relatively flat foamed packages for hot breakfast foods are provided. The packages of this invention provide improved hinging and latching mechanisms whereby the package can be quickly and easily assembled, closed and opened; provide temperature and humidity control for contained hot breakfast foods; have integral handle means for transporting the package; and provide an internal plate surface which resists cutting when knife and fork are used.

The improved foamed package of this invention comprises a lower dish section and an upper cover section for covering the dish section. The dish section comprises a food support floor and an upstanding peripheral sidewall including front, back and first and second sidewalls which extend upwardly and outwardly from the floor to an upper peripheral wall edge. The dish section defines an outwardly extending peripheral flange which circumscribes a major portion of the upper peripheral wall edge and which includes handle means projecting laterally of the first and second sidewalls for gripping and carrying the dish section. The floor is proportioned to support the dish section on a table surface and has an internal plate surface which is relatively hard to resist cutting when food is supported on the plate surface.

The cover section comprises a top wall and a sidewall extending downwardly and outwardly from the top wall to a lower peripheral wall edge. The cover section is proportioned such that a marginal portion of the top wall embraces the flange on the dish section when the cover section is juxtaposed with the dish section.

The package of this invention includes a hinging mechanism and a latching mechanism for the dish and cover sections. The hinging mechanism includes at least one hinging tongue on the dish section projecting generally rearwardly from the back sidewall, and a complementary hinging aperture defined by the sidewall of the cover section for each hinging tongue. Each hinging aperture opens laterally of the sidewall of the cover section, is positioned adjacent the lower peripheral wall edge, and has a width at least as great as the width of the hinging tongue.

Each hinging tongue projects outwardly and downwardly with respect to a plane perpendicular to the floor, and projects at an angle of about 5° with respect to the floor, thereby to facilitate the juxtapositioning of the hinging tongues in the corresponding hinging apertures when assembling the package.

The latching mechanism comprises a latching tongue on the dish section projecting forwardly from the front sidewall and lying in a plane substantially parallel to the floor of the dish, and a complementary latching aperture defined by the sidewall of the cover section. The latching aperture opens forwardly of the sidewall of the cover section, is positioned adjacent the lower peripheral wall edge, and has a width at least as great as the width of the latching tongue.

The cover section has a web at the base of each hinging aperture and latching aperture. The web projects outwardly of the sidewall of the cover section, and is proportioned to underlie each hinging tongue and latching tongue when the cover and dish sections are juxtaposed and latched.

The front sidewall of the dish section is sufficiently resilient so that when it is pushed inwardly, it will allow the latching tongue to be retracted inwardly of the inner edge of the surfaces defining the latching aperture, and so that when it is released it will bias the latching tongue outwardly through the latching aperture so that the latching tongue projects over the associated web. The sidewall of the dish section maintains an outward bias against the sidewall of the cover section to help maintain the hinging and latching mechanisms in a hinged and latched condition, thereby to prevent accidental opening of the package.

The latching tongue preferably projects outwardly from the uppermost peripheral wall edge of the dish front sidewall and preferably merges with the front sidewall of the dish in a reinforcing strut.

Further objects, features, and advantages of this invention will become apparent from the following description and drawings, of which:

Figure 12:
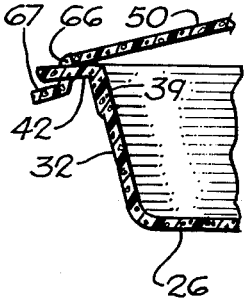
FIG. 12 is a fragmentary cross-sectional view of the food package of FIG. 1 in a partially closed position.

A relatively flat foam breakfast food package 20 in accordance with this invention may comprise a lower shallow dish section 22 and an upper relatively flat cover section 24. Hinging and latching mechanisms, comprising tongues on the dish section which are receivable in complementary apertures in the cover section, are provided to enable a user to move the package 20 from the closed, latched position of FIG. 1 to the intermediate position of FIG. 12 and to the open position of FIG. 2. Package 20 is preferably of expanded polystyrene of the closed-cell type, thereby to provide excellent insulating characteristics.

As shown in FIGS. 2, 7, 10 and 11, dish section 22 comprises an internal food support surface or floor 26 and an upstanding peripheral sidewall 28 which extends upwardly and outwardly from the floor 26 to an upper peripheral wall edge, and which sidewall includes front sidewall 30, back sidewall 32, and first and second sidewalls 34 and 36. The four sidewall portions 30, 32, 34 36 which define sidewall 28 merge in curved, sloping intersections 38. In the embodiment illustrated, floor 26 is substantially rectangular, with each of its four corners being gently rounded. The external surface of the dish section is relatively flat to support it on a table surface. The internal surface 27 of floor 26 is relatively hard to resist cutting, and may be formed with a hardened skin in accordance with conventional techniques, thereby to resist cutting when a knife and fork are used.

Figure 10:
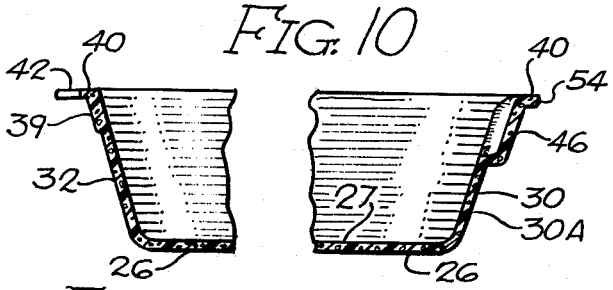
FIG. 10 is a fragmentary cross-sectional view taken along plane 10—10 of FIG. 2.
Figure 11:
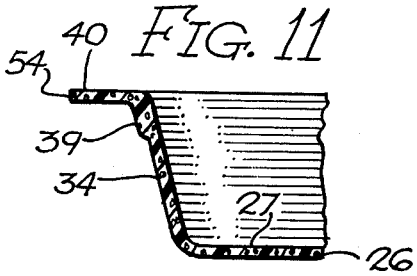
FIG. 11 is an enlarged fragmentary cross-sectional view taken along plane 11—11 of FIG. 7.

Thickened wall beads 39 are provided adjacent the upper peripheral edge of sidewall 28, as illustrated in FIGS. 10 and 11. The beads 39 circumscribe the entire sidewall 28 except for a central portion of front sidewall 30 where the latching mechanism, which is described hereinbelow, is located. The beads 39 provide reinforcement and strength for the dish section 22 and also serve as stacking beads to provide for the easy and rapid denesting of a stack of food packages 10.

The dish section 22 also includes a peripheral flange 40 which extends outwardly from the uppermost edge of sidewall 28 and circumscribes a major portion of the upper peripheral wall edge. The portion of flange 40 which projects laterally of the first and second sidewalls 34 and 36 and beyond the underlying wall beads 39 is particularly elongated so that it can be grasped by a user for carrying the dish section 22 or the entire package 20. The flange 40 also strengthens the dish section 22.

Back sidewall 32 mounts at least one, and preferably two, generally flat, blade-like bayonet hinging tongues 42 which project generally rearwardly from the back sidewall 32. The hinging tongues 42 preferably comprise extensions of flange 40. Hinging tongues 42 extend outwardly and downwardly with respect to a plane parallel to floor surface 26, and form an angle of about 5° relative to that parallel plane. As will appear, when the cover section is to be assembled with dish section 22, the downward inclination of the hinging tongues will tend to prevent the tongues from binding against or digging into the inside surface of the cover section, thereby facilitating the assembly of a package 20.

The front sidewall portion 30 mounts a generally flat, blade-like bayonet latching tongue 44 which projects forwardly and outwardly from the uppermost edge of front sidewall 30 and which is generally coplanar with flange 40. Latching tongue 44 lies in a plane which is generally parallel to floor 26 and to the plane of a table surface when the dish section 22 is supported on a table surface. Latching tongue 44 is provided with an underlying reinforcing member or strut 46 which merges with the latching tongue 44 and front sidewall 30 and which, in the embodiment illustrated, projects forwardly from front sidewall 30 to strengthen and support latching tongue 44.

As described hereinabove, the wall beads 39 terminate at front sidewall 30 in laterally spaced relation to latching tongue 44. This promotes the flexibility of the central area 30A of front sidewall 30 when it is to be pressed inwardly the distance necessary to retract the latching tongue 44 to allow it to enter a complementary latching aperture in cover section 24.

Figure 1:
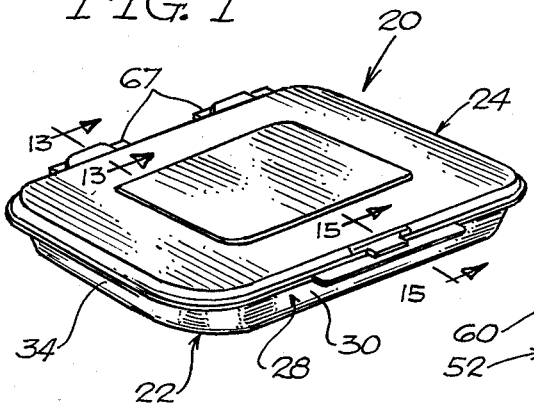
FIG. 1 is a perspective view of a food package of this invention in the closed, latched position.
Figure 8:
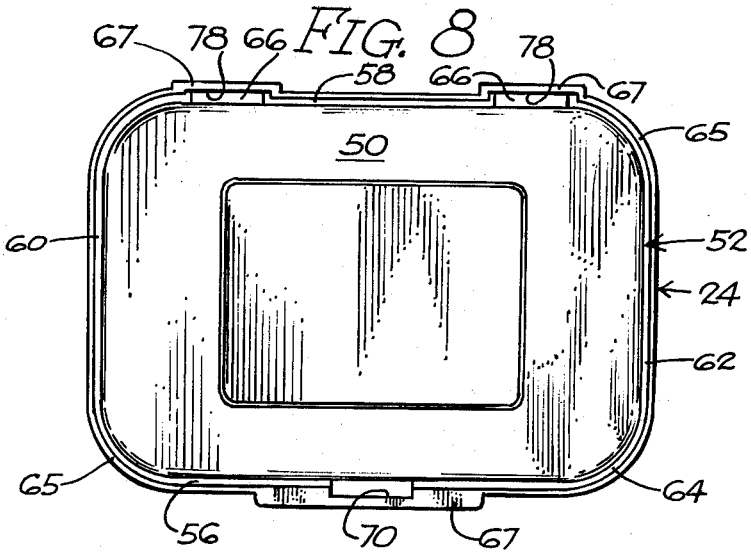
FIG. 8 is a bottom view of the cover section of the food package of FIG. 1.

The upper cover section 24 comprises a top wall 50 and a sidewall 52 which extends downwardly and outwardly from the top wall 50 to a lower peripheral wall edge. Cover section 24 is proportioned such that a marginal portion of the top wall 50 embraces the flange 40 on the dish section 22 when the cover section is juxtaposed with the dish section as shown in FIG. 1, the sidewall 52 of the cover section receiving the flange 40 and being in juxtaposition with the outermost edge 54 of flange 40. Top wall 50 is substantially rectangular, with each of the four corners being gently rounded. Sidewall 52 comprises front sidewall 56, back sidewall 58, and first and second sidewalls 60 and 62 which merge in curved, sloping intersections 64 (FIG. 8). An outwardly projecting peripheral web 65 circumscribes the lower peripheral wall edge and projects laterally of the lowermost edge of sidewall 52 to provide additional strength for cover section 24.

Figure 13:
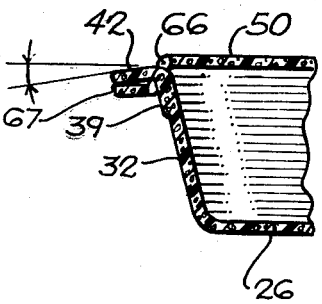
FIG. 13 is an enlarged fragmentary cross-sectional view taken along plane 13—13 of FIG. 1.

The back sidewall 58 of cover section 24 defines hinging apertures 66 which are complementary to each hinging tongue 42 and which face rearwardly of the cover section 24 and laterally of sidewall 52. Each hinging aperture 66 is proportioned to receive a corresponding hinging tongue 42, thereby to provide a hinging mechanism for package 20. Each hinging aperture 66 is at least as wide as the hinging tongue 42, and is preferably somewhat greater in height than the thickness of the hinging tongue 42, thereby to permit pivoting movement from the closed position of FIG. 1 to the open position of FIG. 2. Each hinging aperture 66 is positioned adjacent the lower peripheral wall edge, and is bordered at its bottom by an elongated portion 67 of web 65, as shown in FIG. 13.

Figure 3:
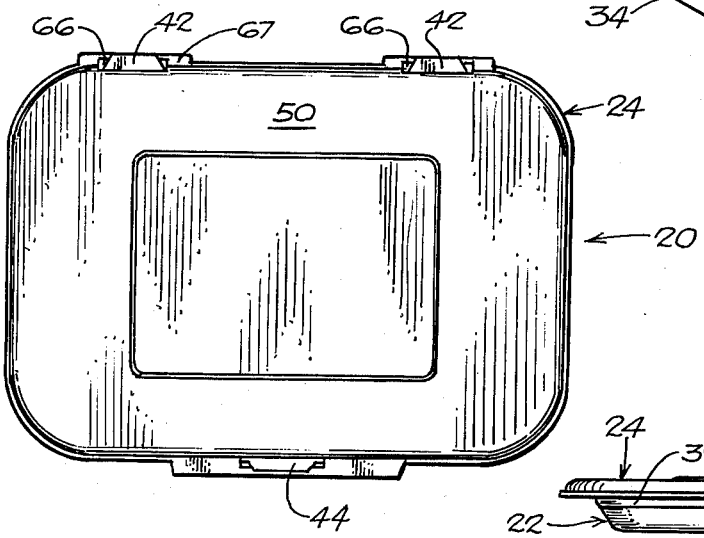
FIG. 3 is a top plan view of the food package of FIG. 1.
Figure 4:
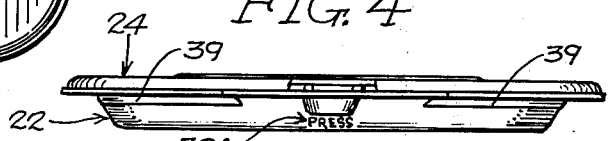
FIG. 4 is a front elevational view of the food package of FIG. 1.
Figure 5:
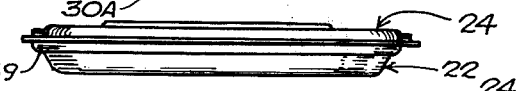
FIG. 5 is a side elevational view of the food package of FIG. 1.
Figure 6:
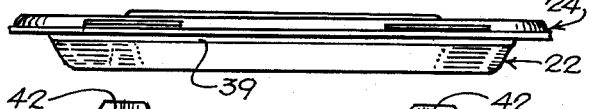
FIG. 6 is a rear elevational view of the food package of FIG. 1.
Figure 7:
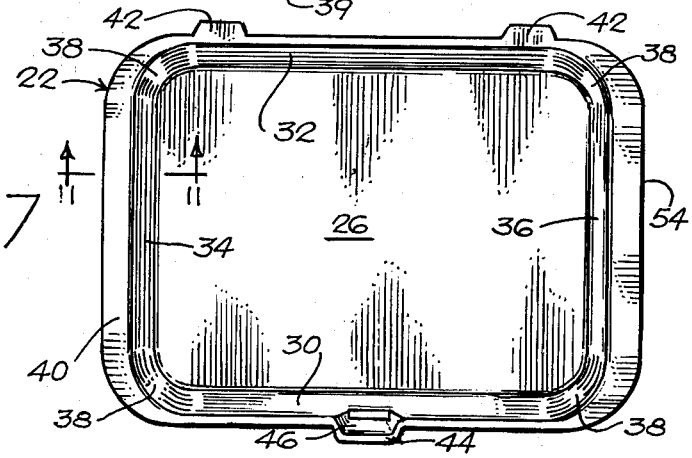
FIG. 7 is a top plan view of the dish section of the food package of FIG. 1.

Front sidewall 56 of cover section 24 defines a latching aperture 70 positioned adjacent to the lower peripheral wall edge and which opens and faces forwardly of the cover section 24 and laterally of sidewall 52. Latching aperture 70 is proportioned to receive the latching tongue 44 and has a width at least as great as the width of the latching tongue 44, thereby to provide a latching mechanism for package 20. As shown in FIGS. 3 and 8, web 65 serves to define the base of hinging apertures 66 and latching aperture 70. The expansive elongated portions 67 of the web are proportioned to underlie the hinging tongues 42 and latching tongue 44, and provide enhanced strength, thereby to resist tearing, breaking and flexing of the web 65 adjacent the aperture 66 and 70 from its connection with cover section 24.

Figure 14:
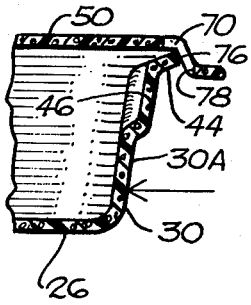
FIG. 14 is a cross-sectional view of the food package of FIG. 1 in the position which is assumed when the front sidewall of the dish section is retracted for latching.
Figure 15:
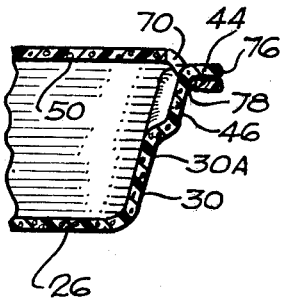
FIG. 15 is an enlarged fragmentary cross-sectional view taken along plane 15—15 of FIG. 1.

Sidewall 28 of dish section 22 maintains an outward bias against sidewall 52 of cover section 24 to help maintain the hinging and latching mechanism in a hinged and latched condition and to prevent accidental opening of package 20. As shown in FIGS. 14 and 15, the front sidewall 30 of dish section 22 is sufficiently resilient when pushed inwardly to allow the latching tongue 44 to be retracted inwardly of the inner edge of the surfaces defining the latching aperture 70 and to bias the latching tongue 44 outwardly through the latching aperture 70 when the front sidewall 30 of the dish section 22 is released, so that the latching tongue projects over the web 65.

Figure 2:
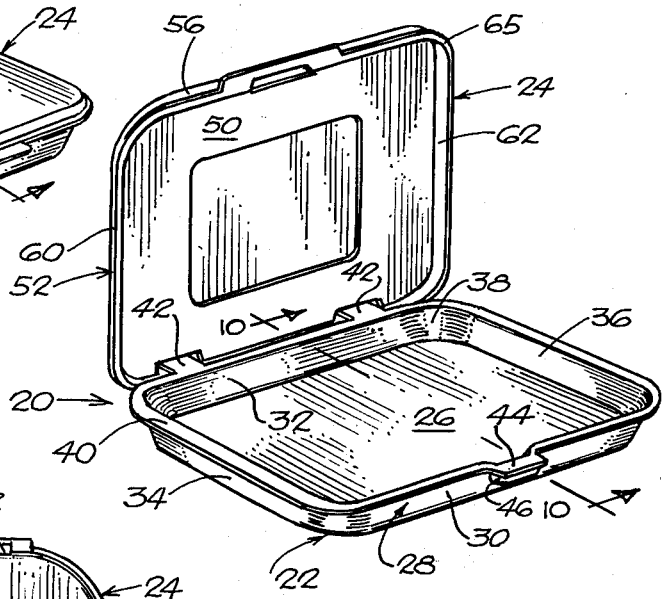
FIG. 2 is a perspective view of the food package of FIG. 1 in an open position.
Figure 9:
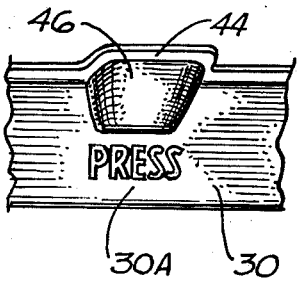
FIG. 9 is a fragmentary front elevational view of a portion of the dish section of FIG. 2.

When the package 20 is to be closed, i.e., to be manipulated from the position of FIG. 2 to a position like that of FIGS. 1 and 4–6, the dish section 22 is grasped and squeezed inwardly in the resilient central area 30A of front sidewall 30 (FIG. 9) until latching tongue 44 is retracted sufficiently to allow the cover section 24 to be moved downwardly to a position in which the forward edge 76 of latching tongue 44 is spaced inwardly of the innermost edge 78 of the web 75 which is one of the surfaces defining the latching aperture 70 (FIG. 14). Then, when pressure against central area 30A is released, the resilient nature of front sidewall 30 causes latching tongue 44 to move forwardly into and outwardly through latching aperture 70 to cause package 20 to remain closed (FIGS. 1 and 15).

Package 20 may be assembled by grasping the cover section 24 and sliding it forward relative to dish section 22 until the hinging tongues 42, which slide along the inside surface of top wall 50, are received in the hinging apertures 66. As such, the downwardly inclined configuration of the hinging tongues 42 relative to floor 26 minimize the possibility of their binding or digging into the inside surface of the top wall 50 as the sliding movement takes place.

The food package described herein provides a number of important features and advantages. When the food package is in the closed, latched position, the package is closed to prevent the entry of excessive cooling air, to prevent internal condensation and excessive cooling, and to retain the heat in the food in the package, while allowing same steam to escape, thereby providing good heat and moisture control. Packages 20 are light-weight, compact, and are easily stacked and separated. The construction of the packages wherein the latching tongues have an outward bias relative to the latching apertures minimizes the likelihood of the unwanted retraction of the latches from the apertures when jarring forces are encountered. The flange 40 on the first and second sidewalls 44 and 46 of the dish section 22 both strengthens the package and provides convenient handles for holding the dish section 22 or the entire package 20. The hardened upper surface of the food support floor 26 resists cutting when a knife and fork are used.

The packages are, of course, reusable and may be opened and closed many times. If desired, the cover section may be used as a secondary food container, since both the dish and cover sections may be seated flat on a table or the like when both are to be used. The packages may also be used for secondary purposes by users, such as for toys and for hobby and craft activities.

While this invention is susceptible of embodiment in many different forms, there has been shown in the drawings and has herein been described in detail one specific embodiment, with the understanding that the present disclosure is to be considered as an exemplification of the principles of the invention and is not intended to limit the invention to the embodiment illustrated.

I claim:

1. A flat foam package for breakfast foods comprising:

a shallow lower dish section having a food support floor and an upstanding peripheral sidewall including front, back and first and second sidewalls which extend upwardly and outwardly from said floor to an upper peripheral wall edge, said lower dish section defining an outwardly extending peripheral flange which circumscribes a major portion of said upper peripheral wall edge and which includes an expansive handle means projecting laterally from each of said first and second sidewalls for carrying said dish section, said floor being proportioned to support said dish section on a table surface, said floor having an inner surface which is relatively hard to resist cutting when food supported on said upper surface is cut;

a relatively flat cover section for covering said dish section, said cover section having a top wall and a sidewall extending downwardly and outwardly from said top wall to a lower peripheral wall edge, said cover section being proportioned such that a marginal portion of said top wall embraces said flange on said dish section when said cover section is juxtaposed with said dish section;

a hinging mechanism for said dish and cover sections including at least one hinging tongue on said dish section projecting generally rearwardly from said back sidewall, and a complementary hinging aperture defined by said sidewall of said cover section for each hinging tongue, each said hinging aperture opening laterally of the sidewall of said cover section, being positioned adjacent said lower peripheral wall edge, and having a width at least as great as the width of said hinging tongue; and a latching mechanism for said dish and cover sections including a latching tongue on said dish section projecting forwardly from said front sidewall and lying in a plane substantially parallel to said floor of said dish, and a complementary latching aperture defined by said sidewall of said cover section, said latching aperture opening laterally of the sidewall of said cover section, being positioned adjacent said lower peripheral wall edge, and having a width at least as great as the width of said latching tongue;

a web at the base of each said hinging aperture and latching aperture and integral with and projecting outwardly of said sidewall of said cover section, one of said webs being proportioned to underlie each of said hinging and latching tongues when said cover and dish sections are juxtaposed and latched;

said front sidewall of said dish section being sufficiently resilient when pushed inwardly to allow the latching tongue to be retracted inwardly of the inner edge of the surfaces defining said latching aperture and to bias said latching tongue outwardly through said latching aperture when said front sidewall of said dish section is released so that said latching tongue projects over its associated web, and said sidewall of said dish section maintaining an outward bias against said sidewall of said cover section to maintain said hinging and latching mechanisms in a hinged and latched condition and to help prevent accidental opening of said package.

2. The package as defined in claim 1 wherein said latching tongue and said front sidewall merge in a reinforcing strut.

3. The package as defined in claim 1 wherein said latching tongue projects forwardly from the uppermost peripheral wall edge of said front sidewall.

4. The package as defined in claim 1 wherein each said hinging tongue projects outwardly and downwardly with respect to a plane parallel to said floor to facilitate in positioning each said hinging tongue in the corresponding hinging aperture when assembling said package.

5. The package as defined in claim 4 wherein each said hinging tongue projects outwardly and downwardly at an angle of about 5° with respect to said parallel plane.

* * * * *